United States Patent [19]

Sugiyama

[11] 4,365,564

[45] Dec. 28, 1982

[54] DRIVING APPARATUS FOR RETAINING FRAME OF OBJECT TO BE SEWED IN AUTOMATIC SEWING MACHINE

[75] Inventor: Jin Sugiyama, Osaka, Japan

[73] Assignee: Unitech Engineering Ltd., Osaka, Japan

[21] Appl. No.: 160,742

[22] Filed: Jun. 18, 1980

[30] Foreign Application Priority Data

Jun. 19, 1979 [JP] Japan ..... 54-77075

[51] Int. Cl.[3] ..... D05B 21/00

[52] U.S. Cl. ..... 112/121.12

[58] Field of Search ..... 112/121.12, 103, 275, 112/277, 121.11

[56] References Cited

U.S. PATENT DOCUMENTS 3,742,879 7/1973 Schaefer, Jr. ..... 112/121.12

4,152,994 5/1979 Sugiyama ..... 112/121.12

4,254,724 3/1981 Conrads ..... 112/277 X

*Primary Examiner*—Peter P. Nerbun

*Attorney, Agent, or Firm*—Wenderoth, Lind & Ponack

[57] ABSTRACT

A driving apparatus for retaining frame of object-to-be-sewed in automatic sewing machine with driving shaft for causing the retaining frame on an object-to-be-sewed to move in the X-axis direction or the Y-axis direction relative to the position of a sewing needle to perform an optional sewing operation. A pulse generator for moving the retaining frame is provided for generating a given number of pulses, between given rotation angles of the driving shaft, in a synchronous relationship with the rotation of the operational shaft, so that the retaining frame of the object-to-be-sewed is moved in an automatic synchronous relationship with respect to the movement of the sewing needle.

6 Claims, 25 Drawing Figures

DRIVING APPARATUS FOR RETAINING FRAME OF OBJECT TO BE SEWED IN AUTOMATIC SEWING MACHINE

BACKGROUND OF THE INVENTION

The present invention relates to a driving apparatus for a retaining frame of an object to be sewed in an automatic sewing machine and, more particularly, an apparatus for driving a tabouret or embroidery frame retaining an object-to-be-sewed to move in the X axis direction or the Y axis direction relative to the position of a sewing needle so as to perform the optional sewing operation in an automatic sewing machine for stitching an embroidery pattern on the object.

More specifically, the present invention pertains to the frame positioning device wherein a stepping motor assembly is employed for each of two drive mechanism for respectively moving the frame in an X-axis direction and in a Y-axis direction perpendicular to the X-axis direction to bring the frame to a predetermined coordinate position. The stepping motor assembly itself may be comprised of a plurality of pulse responsive stepping motors, wherein either respective stators or rotors remain aligned in phase with each other, and the other associated rotors or stators may be angularly offset at a predetermined angle relative to each other on a machine drive shaft.

Conventionally, as shown in an automatic embroidering machine of FIG. 1, an automatic sewing machine is composed of a sewing machine body provided with a driving mechanism 2 for vertically moving an embroidering needle 1 to perform the embroidering operation, a frame 4 for retaining an object 3 to be embroidered thereon, a X-axis driving mechanism 5 for moving the retaining frame 4 in the X-axis direction, a Y-axis driving mechanism 6 for moving the retaining frame 4 in the Y-axis direction, and a control system for controlling the operations of mechanisms 2, 5 and 6 in such a manner that the X-axis numerical data and Y-axis numerical data for respectively moving the retaining frame 4 in the X-axis direction and the Y-axis direction, and the controlling data for controlling the sewing machine body 2 are sequentially read out to a memory circuit 9 by a tape reading apparatus 8 from a numerical data tape 7 such as punched tape or the like, and the data is temporarily stored within the memory circuit 9. A machine driving motor 11 of the driving mechanism 2 for reciprocatingly moving the embroidering needle 1 is adapted to be driven, through a machine drive controlling circuit 10, in accordance with the controlling data outputted from the memory circuit 9. Pulses outputted from a pulse generator 12, which is composed of a crystal oscillating circuit or the like for generating the pulses of a constant frequency, are inputted to a X-axis pulse converting circuit 13 and a Y-axis pulse converting circuit 14, each of which is composed of a gate circuit or the like, and such circuits are controlled by the X-axis numerical data (X) and the Y-axis numerical data (Y) outputted from the memory circuit 9. Pulses outputted from the pulse generator 12 are triggered to transmit the X-axis numerical data (X) and the Y-axis numerical data (Y) from the X-axis pulse converting circuit 13 and the Y-axis pulse converting circuit 14 to a X-axis driving circuit 15 and a Y-axis driving circuit 16, respectively, as the pulse row of numerical data number. The X-axis driving circuit 15 and Y-axis driving circuit 16 respectively drive an X-axis stepping motor Mx of the Y-axis driving mechanism 5 and a Y-axis stepping motor My of the Y-axis driving mechanism 6. The X-axis driving mechanism 5 and the Y-axis driving mechanism 6 move the retaining frame 4 respectively in the X-axis direction and the Y-axis direction to thereby perform the optional embroidering operation.

However, as apparent from the above description in the automatic embroidering machine, the moving speed of the retaining frame 4 for the object-to-be-embroidered 3 is regulated by the frequency of a reference pulses outputted by the pulse generator 12. The numerical data of the memory circuit 9 for determining the motion amount of the retaining frame 4 in the X-axis direction and the Y-axis direction vary principally from $2^0$ to $(2^n-1)$ in accordance with the instruction contents of the numerical tape 7. Accordingly, the moving time of the retaining frame 4 to be driven every time by the stepping motors Mx and My is varied in proportion to the numerical data by the tape instructions. Thus, the frequency of the reference pulses of the pulse generator 12 is normally set to a maximum limit value in order to be able to transmit the instructions at the maximum numerical value of the tape 7. As soon as the embroidering needle 1 leaves the object-to-be-embroidered 3, the retaining frame 4 begins to move and, then, a given amount of the motion of the retaining frame 4 is set to be normally completed, before the embroidering needle 1 is thrust into the object 3 again, even if the maximum moving time of the retaining frame 4 is required by the data of the maximum numerical value. If it is assumed that the frequency of the reference pulse is f(0) and the time t(0) required for reciprocating the embroidering needle 1 to leave from and to thrust into the object 3 at every cycle, i.e. the allowable length of time with respect to the motion of the retaining frame 4, then it is necessary to normally maintain the relationship: $1/f(0) \leqq t(0)$ in order to prevent the motion of the retaining frame 4 from interfering with the embroidering needle 1. Although the allowable time length t(0) depends upon the rotating speed of the mechanical system such as the machine driving motor 11 or the like and the frequency f(0) of the reference pulse is artificially set in the synchronous range, considering the above conditions of the retaining frame 4 and embroidering needle 1, in the pulse generator 12, both values are independent of each other. Thus, when the numerical data instructed by the tape 7 is set at one half the maximum numerical value, the retaining frame 4 is driven to complete its motion in the first half of the allowable time length t(0) and waits for the re-thrust of the embroidering needle 1, the retaining frame 4 being in an inoperative position during the second half of the allowable time. Since most of the numerical data of the tape instructions used for the normal operation are smaller than the maximum value and remain, in average value, from 60% to 70% of the maximum value, in the automatic embroidering machine, a waiting time of from 30% to 40% is usually wasted, thus resulting in a decrease in the top limit of the operation speed of the mechanical system. Also, when the rotating speed of the sewing machine has been increased due to some reasons, the allowable motion time changes to a value t(1) which is less than t(0), and, unless the correction of proper frequency f(0) is otherwise applied, the motion time of the retaining frame 4 depending upon the frequency f(0), which was predetermined in accordance with the speed of the mechanical system before the changing is extended to $1/t(0) > t(1)$, when the numerical data is maximum in value or is close thereto. As a result, the allowable motion time becomes insufficient and the embroidering needle 1 might be broken or the object 3 might be torn off. In addition, the embroidering needle 1 may be left within the object 3, the retaining frame 4 started to move so as to interfere with the embroidering needle 1, and the given motion of the retaining frame 4 not completed even in the re-thrust of the embroidering needle 1. Also, after the thrust, the remaining movement of the frame is performed. Even when the user decreased the rotational speed of the sewing machine due to sewing machine thread cutting or to improve the operational quality, the moving speed of the frame did not change, thus being unable to take advantage of the resultant speed change.

SUMMARY OF THE INVENTION

The present invention is provided to remove the conventional problems in a driving apparatus for the retaining frame of an object-to-be-sewed in an automatic sewing machine.

Accordingly, the present invention is intended to provide a frame driving device for an automatic sewing apparatus, which is capable of moving embroidery frames at high speeds and with great positional accuracy relative to stitching needles.

Another object of the present invention is to provide a frame driving device of the type referred to above which comprises stepping motor assemblies each capable of giving a relatively great output torque and accurately operable in response to applied input pulses.

According to the present invention, the automatic stitching apparatus to which the present invention is applicable comprises at least one sewing machine having a sewing machine body for causing a sewing needle to be vertically moved to perform the sewing operation, a retaining frame for an object-to-be-sewed, a X-axis driving mechanism for causing said retaining frame to move in the X-axis direction, a Y-axis driving mechanism for causing said retaining frame to move in the Y-axis direction, a reading-out means for reading out said sewing pattern information from a memory apparatus wherein a desired sewing pattern information is stored so as to output X-axis numerical data, Y-axis numerical data and controlling data, a driving circuit of a sewing needle for driving said sewing machine body in accordance with said controlling data outputted from said reading-out means, a pulse generator, gate means of the X-axis direction and the Y-axis direction for passing the output pulses from said pulse generator in accordance with said X-axis numerical data and Y-axis numerical data, and a X-axis driving circuit and a Y-axis driving circuit for respectively driving said X-axis driving mechanism and Y-axis driving mechanism in accordance with the outputs of the gate means of the X-axis direction and Y-axis direction to thereby perform an optional sewing operation while moving the retaining frame of said object-to-be-sewed in the X-axis direction and Y-axis direction, said sewing machine characterized in that a pulse generator is provided for moving the retaining frame of an object-to-be-sewed in the X-axis direction and the Y-axis direction at a timing determined by the output pulse and comprises a pulse generator for generating a given number of pulses between given rotation angles of its operation shaft in a synchronous relationship with the rotation of the operational shaft wherein, the retaining frame of the object-to-be-sewed is moved in an automatic synchronous relationship with the moving speed of the sewing needle and the allowed movable time is used to its maximum, to thereby complete the motion of the retaining frame before the tip end of the sewing needle is thrust into the object-to-be-sewed so that the embroidering needle is not broken if the object-to-be-sewed is varied in thickness and the retaining frame moves in a synchronous relationship with the motion of the sewing needle to smoothly perform the sewing operation.

BRIEF DESCRIPTION OF THE DRAWINGS

These and other objects, features, aspects and advantages of the present invention will become more apparent from the following detailed description of the present invention when taken in conjunction with the accompanying drawings, in which.

DETAILED DESCRIPTION OF THE INVENTION

Figure 1:
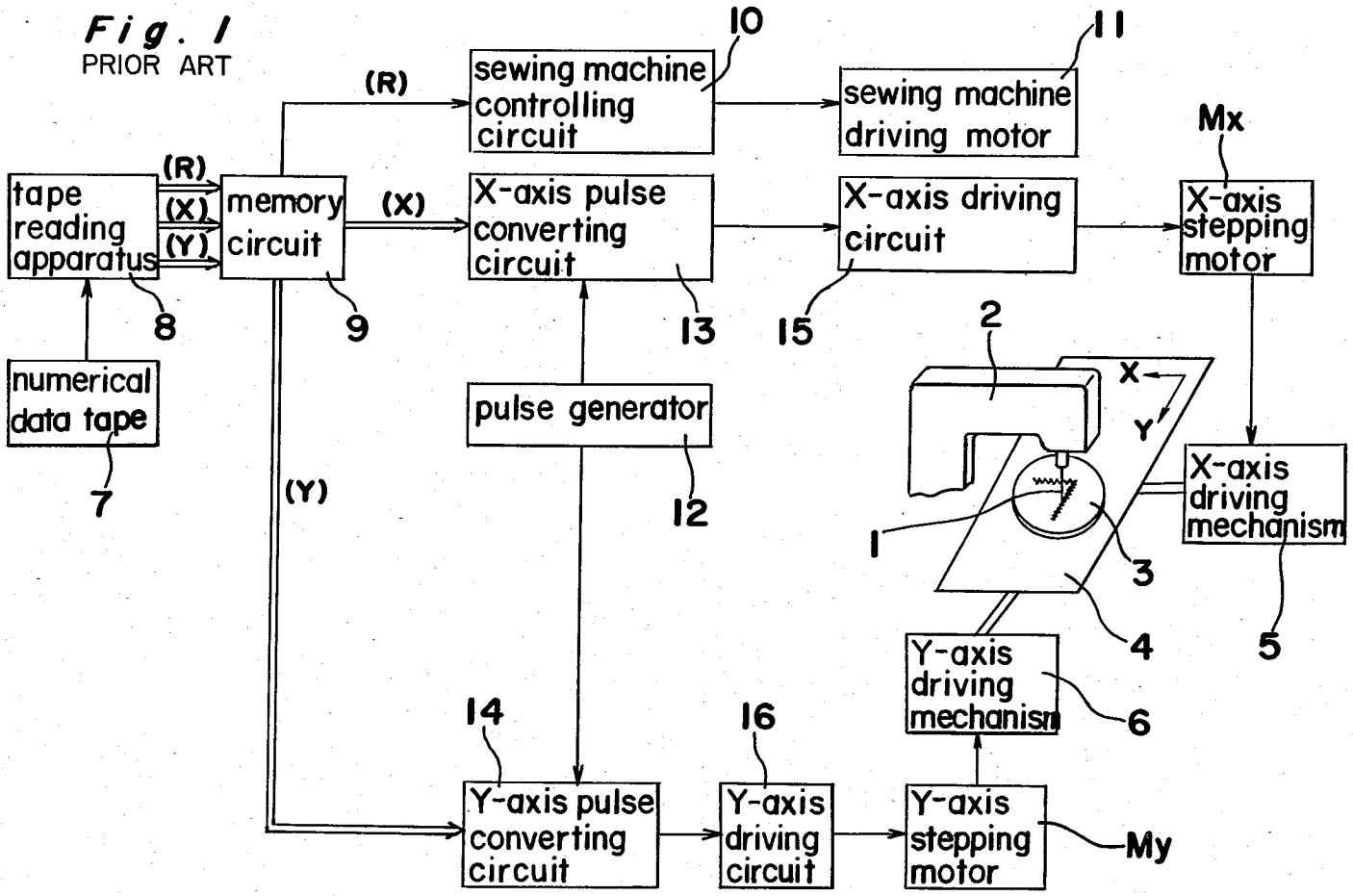
Fig. 1 PRIOR ART
FIG. 1 is a block diagram of the conventional automatic sewing machine as referred above.

Before the description of the present invention proceeds, it is to be noted that like parts are designated by like reference numerals throughout the accompanying drawings.

An automatic sewing machine providing with a driving apparatus for retaining frame of object-to-be-sewed in accordance with the present invention comprises a sewing machine body for causing a sewing needle to be vertically moved to perform the sewing operation, a frame for retaining an object-to-be-sewed, a X-axis driving mechanism for causing said retaining frame to move in the X-axis direction, a Y-axis driving mechanism for causing said retaining frame to move in the Y-axis direction, a reading-out means for reading out said sewing pattern information from a memory apparatus wherein a desired sewing pattern information is stored so as to output X-axis numerical data, Y-axis numerical data and controlling data, a circuit for driving said sewing needle of the sewing machine body in accordance with said controlling data outputted from said reading-out means, a pulse generator, gate means of the X-axis direction and the Y-axis direction for passing the output pulses from said pulse generator in accordance with said X-axis numerical data and Y-axis numerical data, and a X-axis driving circuit and a Y-axis driving circuit for respectively driving said X-axis driving mechanism and Y-axis driving mechanism in accordance with the outputs of the gate means of the X-axis direction and Y-axis direction to thereby perform an optional sewing operation while moving the retaining frame of said object-to-be-sewed in the X-axis direction and Y-axis direction, said driving apparatus being characterized in that said pulse generator comprises a pulse generator for generating a given number of pulses, between the given rotation angles of its operation shaft, synchronizing said pulse generator with the rotation of the operation shaft for vertically moving said sewing needle, and said X-axis driving mechanism and Y-axis driving mechanism are adapted to be driven in a synchronous relationship with the motion speed of said sewing needle.

Referring to FIGS. (2(*a*) and 2(*b*), a plurality of sewing machine heads H1, H2, H3 and H4 are provided, respectively, with embroidering needles N1, N2, N3 and N4 on the sewing machine base 24. A machine drive shaft 21 is disposed extending through the four sewing machine heads H1, H2, H3 and H4 and makes one revolution with respect to the respective one reciprocating motion of the embroidering needles N1, N2, N3 and N4. An outer frame 22 is adapted to move embroidering frames F1, F2, F3 and F4, which are provided respectively in the operating positions of the sewing machine heads H1, H2, H3 and H4. A Y-axis stepping motor My consists of two stepping motors May and Mby coupled by a coupling **23*y* and is secured to the sewing machine base 24 to thereby freely move the outer frame 22 in the longitudinal direction (hereinafter referred to as Y-axis direction) of the sewing machine base 24, as shown with FIG. 2**(*a*). Also, a X-axis stepping motor Mx consists of two stepping motors Max and Mbx coupled by a coupling **23*x* and is secured to the sewing machine base 24 to thereby freely move the outer frame 22** in the perpendicular direction (hereinafter referred to as X-axis direction) with respect to the Y-axis direction.

The output of the Y-axis stepping motor My is transmitted to a rack **27*y* through a pinion 25*y* disposed on the output shaft of the stepping motor May, guided by the Y-axis guide shaft 26*y* provided in the Y-axis direction of the sewing machine base 24. The output of the rack 27*y* is adapted to be transmitted to the outer frame 22 through a sliding joint 28*y*, through which a X-axis direction member 22*x* of the outer frame 22 is extended for free sliding motion of the member 22*x* in the X-axis direction in a known manner. Therefore, the outer frame 22** is adapted to freely be displaced in the Y-axis direction through the output of the Y-axis stepping motor My.

On the other hand, in the present embodiment, the outer frame 22 is displaced in the X-axis direction by two sets of rack and pinion, i.e., a pinion **25*ax*, a rack 27*ax* on the stepping motor Max side and a pinion 25*bx* and a rack 27*bx* on the stepping motor Mbx side, since it is difficult in equilibrium to smoothly move the outer frame 22 in the X-axis direction by one rack and pinion unit due to the larger Y-axis direction expansion than the X-axis direction expansion. Namely, the outputs of the stepping motors Max and Mbx, coupled by a coupling 23*x*, are transmitted to the racks 27*ax* and 27*bx* to be guided respectively by two X-axis guide shafts 26*ax* and 26*bx*, which are disposed in the X-axis direction of the sewing machine base 24 through the pinions 25*ax* and 25*bx* provided on the output shafts of the respective stepping motors Max and Mbx. The outputs of these racks 27*ax* and 27*bx* are adapted to be transmitted to the outer frame 22 through the sliding joints 28*ax* and 28*bx* through which the Y-axis direction member 22*y* of the outer frame 22 extends for free sliding motion of said member 22*y* in the Y-axis direction in a known manner. Accordingly, the embroidering frame 22** is adapted to be freely displaced even in the X-axis direction through the output of the X-axis stepping motor Mx.

Figure 2A:
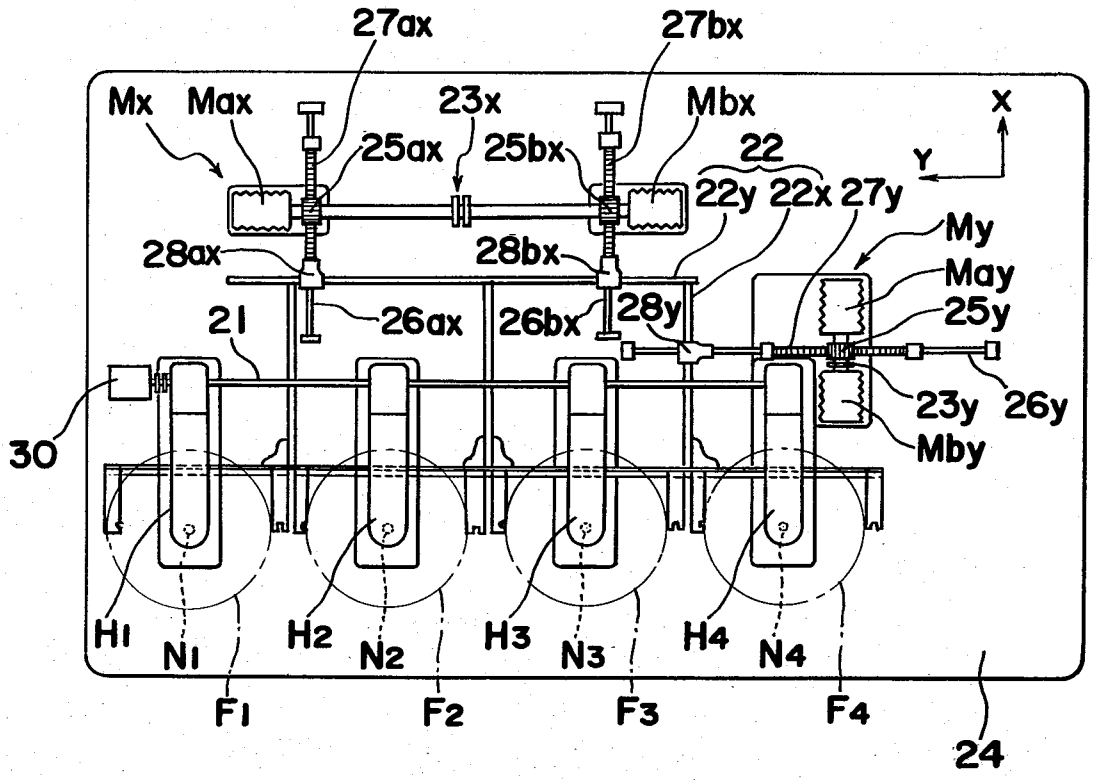
FIGS. 2(*a*) and 2(*b*) are respectively a plan view and a side view of an embroidering machine to which the present invention is applied.
Figure 2B:
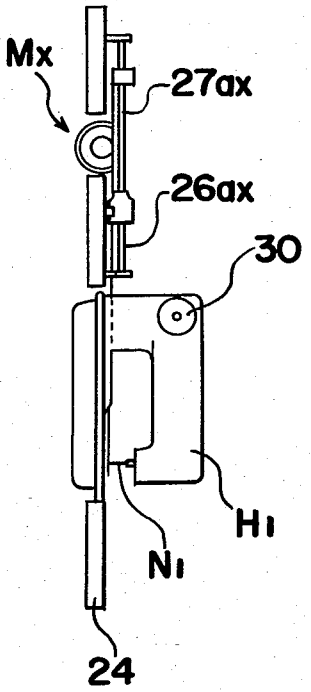

In the present invention, the outer frame 22 of such constructions as described hereinabove in reference of FIG. 2 is driven by a driving apparatus shown in the block diagram of FIG. 3.

Figure 3:
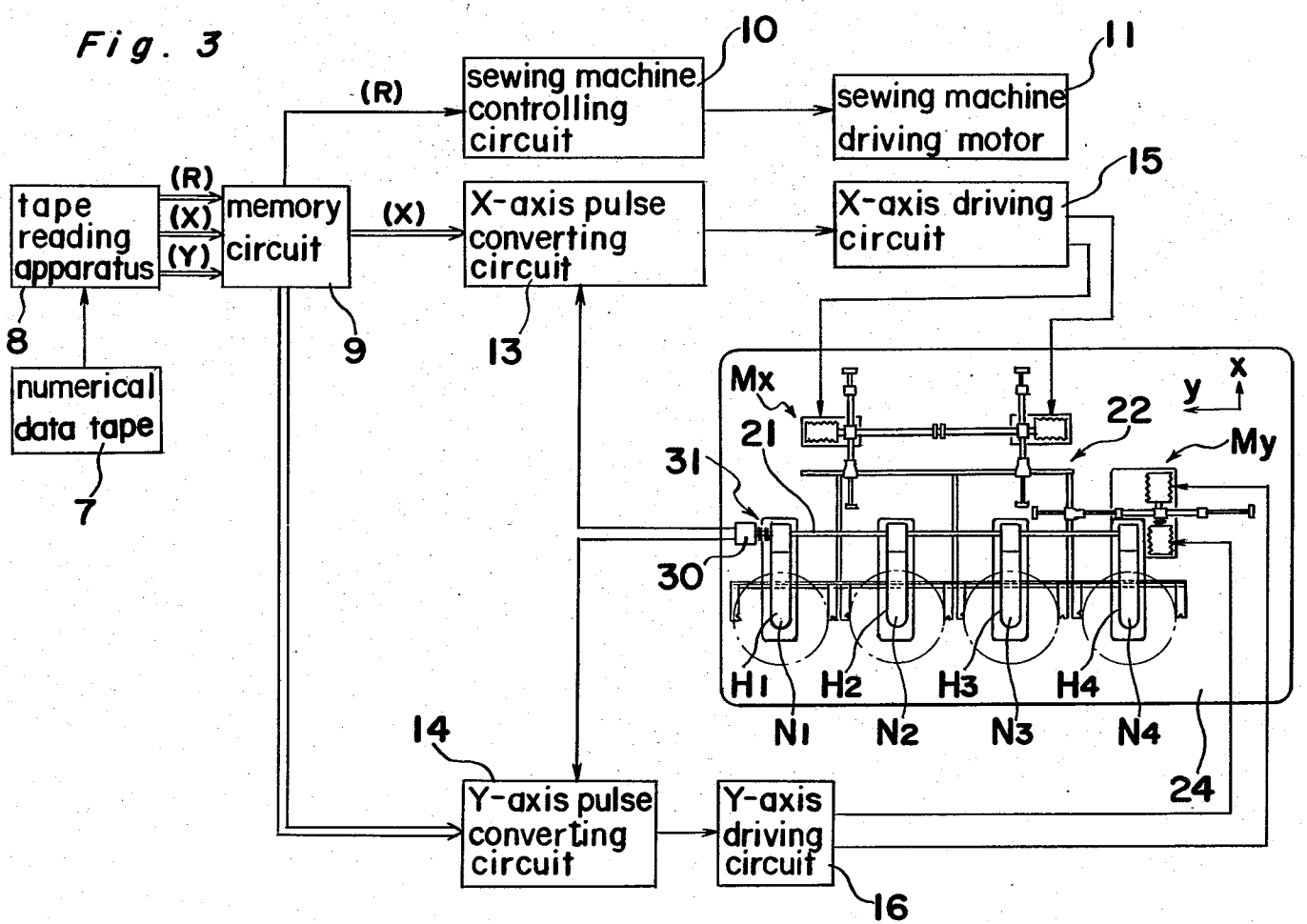
FIG. 3 is a block diagram of a driving apparatus according to the present invention which is applied to the embroidering machine of FIG. 2.

Referring to FIG. 3, a numerical data tape 7, a tape reading apparatus 8, a memory circuit 9, a sewing machine controlling circuit 10, a sewing machine driving motor 11, a X-axis pulse converting circuit 13, a Y-axis pulse converting circuit 14, a X-axis driving circuit 15 and a Y-axis driving circuit 16 are the same as those shown in FIG. 1 in known constructions.

A pulse generator 30 is different from the pulse generator 12 shown in FIG. 1, and composed of a crystal oscillating circuit or the like for generating constant-frequency pulses. According to the present invention, the driving apparatus having a construction as described in FIG. 4 is used, wherein the pulse generator 30 is connected, by a coupling 31 or the like, with the driving shaft 21, which drives the sewing needles N1, N2, N3 and N4 vertically, i.e., in the Z-axis direction.

Figure 4:
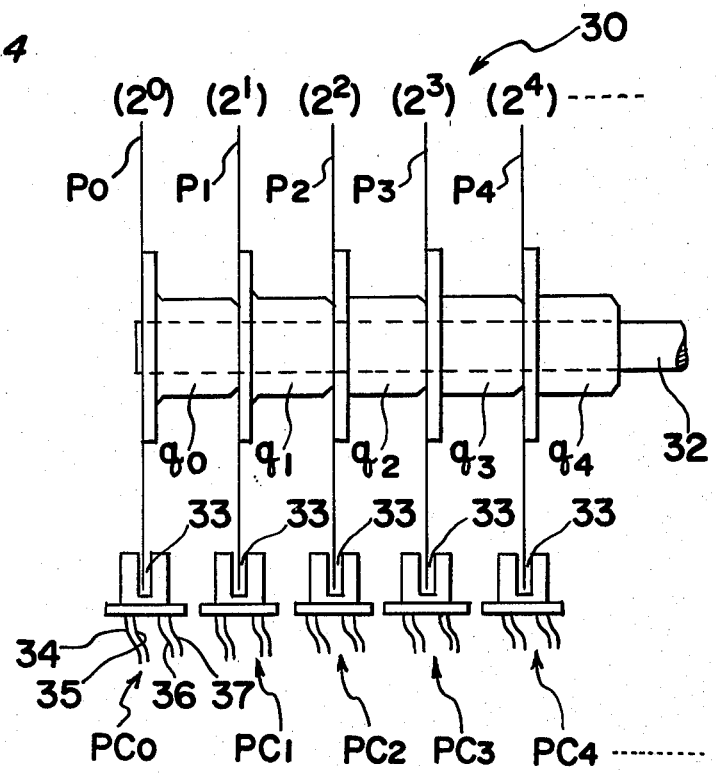
FIG. 4 is a schematic view for illustrating the construction of a pulse generator composed of a plurality of interceptors and photo-couplers to be employed in the driving apparatus of FIG. 3.
Figure 5:
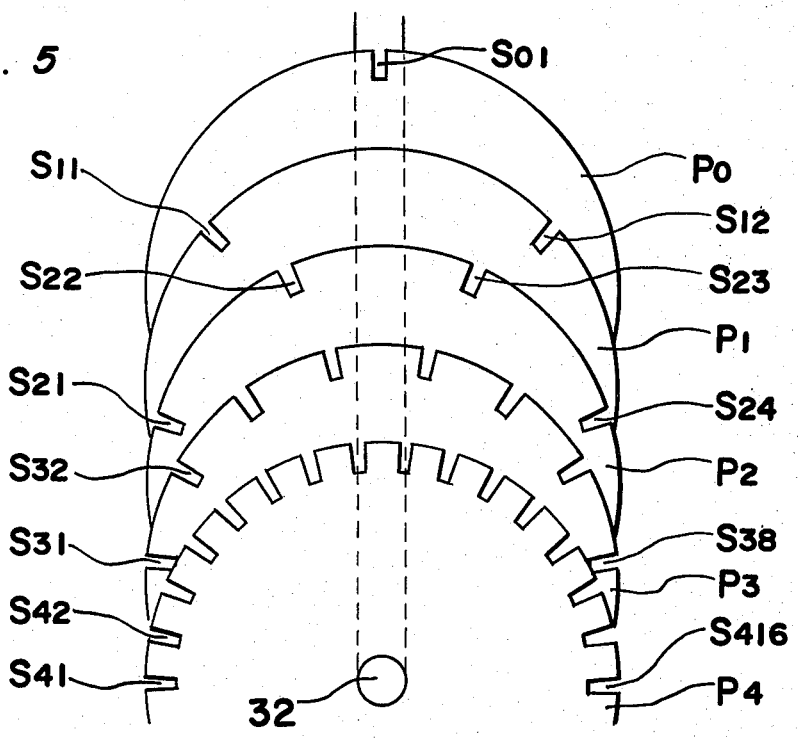
FIG. 5 is a developmental view for illustrating the construction of the interceptor of FIG. 4.

Referring to FIG. 4, circular interceptors P0, P1, . . . , P4, . . . of a disk type are secured with bushings q0, q1, . . . , q4, . . . to a shaft 32, which is connected with the driving shaft 21 by the coupling 31 to rotate together, as shown in FIG. 3. These interceptors P0, P1, . . . , P4, . . . are provided in number equal to the bit number n of binary code of the X-axis numerical data and Y-axis numerical data, which are outputted from the tape reading apparatus 8. The first interceptor P0 is caused to correspond to lowermost bit (LSB) of the X-axis numerical data or of the Y-axis numerical data, the interceptors P1 and P2 correspond, respectively, to the second and third bits, and following interceptors to subsequent bits thereof. For instance, one slit $S_{01}$ representing bits of $2^0$ is provided in the outer periphery of the interceptor P0, two slits $S_{11}$, $S_{12}$ representing bits of $2^1$ in the outer periphery of interceptor P1, four slits $S_{21}$, $S_{22}$, $S_{23}$, $S_{24}$ representing bits of $2^2$ in the outer periphery of interceptor P2, eight slits $S_{31}$, $S_{32}$, $S_{33}$, . . . , $S_{38}$ representing bits of $2^3$ in the outer periphery of interceptor P3, sixteen slits $S_{41}, S_{42}, \ldots, S_{416}$ in the outer periphery of interceptor P4, and so on. This is illustrated in FIG. 5. As shown in FIG. 4, a plurality of photo-couplers PC0, PC1, . . . , PC4, . . . are provided in alignment with each other adjacent to the corresponding interceptors of the pulse generator 30. The photo-couplers have grooves 33 respectively, through which the slits $S_{01}$, $S_{11}, S_{12}, \ldots, S_{41}, \ldots$ provided in the outer peripheral portions of these interceptors P0, P1, . . . , P4, . . . pass during the rotation of the interceptors P0, P1, . . . , P4, . . . together with the shaft 21.

Figures 6, 7:
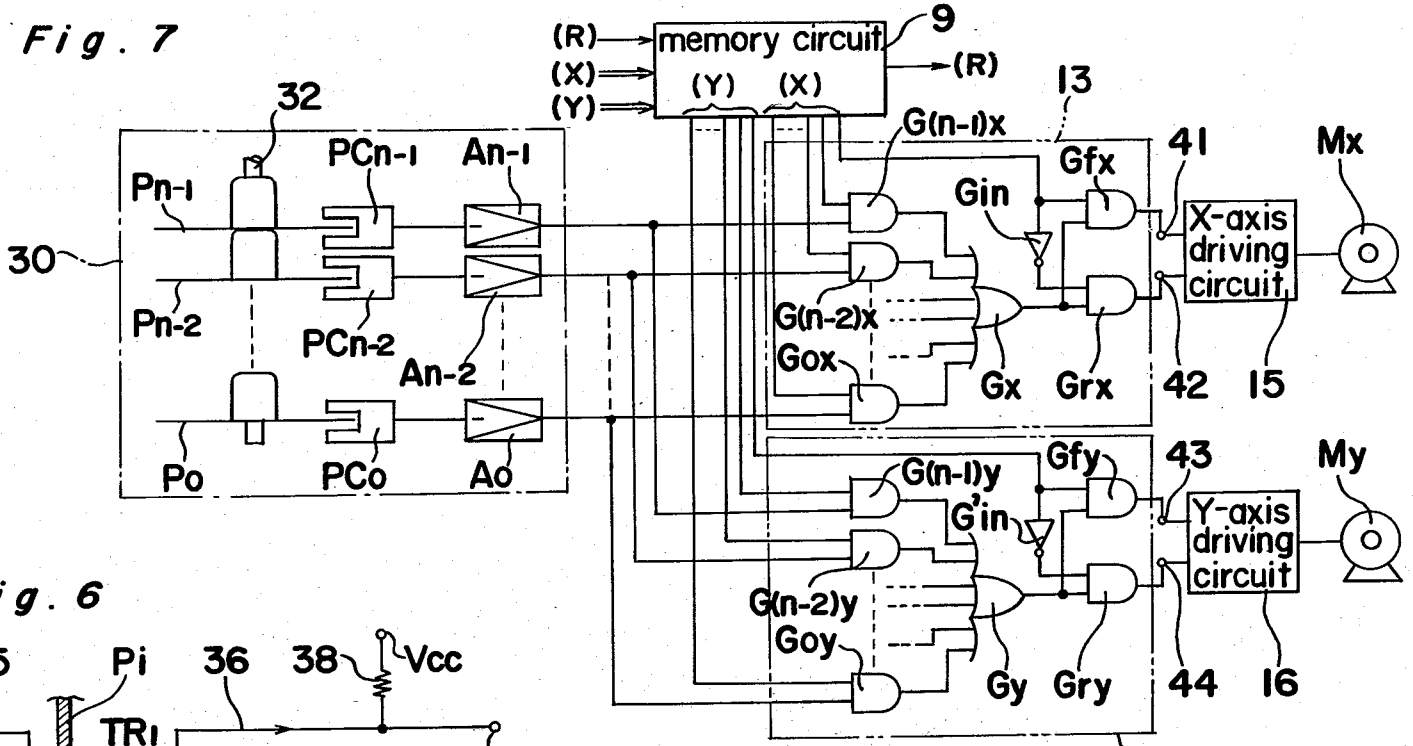
FIG. 6 is a circuit diagram of the photo-coupler to be employed in the pulse generator of FIG. 4.
FIG. 7 is a circuit diagram composed of a X-axis pulse converting circuit and a Y-axis pulse converting circuit to be employed in the driving apparatus of FIG. 3.

As shown in FIG. 6, each of the photo-couplers PC0, PC1, . . . , PC4, . . . is composed of a known construction including a light-emitting diode D, a photo-transistor Tr1, a transistor Tr2 connected with the photo-transistor Tr1 in a darlington-connection, etc., wherein the anode and cathode of the light-emitting diode D are drawn out as lead wires 34 and 35 and the collector and emitter of the transistor Tr2 are drawn out as lead wires 36 and 37.

The light-emitting diode D and the photo-transistor Tr1 are oppositely disposed through the groove 33 of the photo-couplers and the slits sij ($j=1, \ldots 2^n$) of the interceptor pi ($i=0, \ldots, n-1$) passes therebetween so that the photo-pulses may become incident to the actuation of the photo-transistor Tr1.

Accordingly, a pair of light-emitting diode D and interceptor pi with slits form one unit of photo-pulse generating means, while the photo-transistor Tr1 and the transistor Tr2 constitutes a photoelectric conversion means for converting the photo-pulses of the photo-pulse generating means into electric pulses.

The collector of the transistor Tr2 is connected with a power supply Vcc through a resistor 38 and the emitter thereof is connected to ground. Every time the photo-pulse is inputted to the photo-transistor Tr1, the transistor Tr2 is turned on to output an electric pulse, wherein the potential falls from the power supply Vcc potential to the ground potential in a synchronous relationship with the rotation of the interceptors driven by the driving shaft 21 of the sewing machine, from between the terminals 39 and 40 connected, respectively, with the collector and emitter of the transistor Tr2.

The slits Sij provided in each interceptor pi are formed in distribution of equal intervals within a portion of the periphery having a rotating angle of the interceptor pi, for example, from about 180° to 200°, the angle of the periphery portion to be provided with the slits being hereinafter referred to as angle $\theta$, wherein the interceptor pi is rotated to pass the slits through the groove 33 of the photo-coupler PCi in a period ranging from slightly after the front tips of the sewing needles N1, N2, N3 and N4 left an object-to-be-sewed (not shown) to a little before the front tips are thrust into the object-to-be-sewed, the slits being distributed on the interceptor pi mounted on the shaft 32 so as not to let the pulses be outputted at the same time from two or more of the photo-couplers. In other words, it is to be noted that the interval of the slits is provided in correspondence with a time defined between where the first slit of interceptors passes through the groove 33 of the photo-couplers in a period ranging just after the tips of the sewing needles N1, N2, N3 and N4 left an object-to-be-sewed (not shown), and where the last slit of interceptors passes in a period ranging a little before the front tips of the said needles are thrust again into the object-to-be sewed after passing top needle position. Within this interval, all slits on each interceptor have respectively passed through the grooves 33. On the other hand, each interceptor has slits in the different numbers and in the different distribution within the said interval $\theta$. The assembly of the interceptors mounted on the shaft 32 is arranged so as to not let the pulses be outputted at the same time from two or more of the photo-couplers.

As shown in FIG. 7, the output of the transistor Tr2 of the photo-coupler PCi is inputted, respectively, to inversion amplifiers Ai ($i=0, \ldots, n-1$). After the output of the transistor Tr2 is inversion-amplified in the amplifiers, it is inputted to the X-axis pulse converting circuit 13 and the Y-axis pulse converting circuit 14.

Namely, in the construction shown in FIG. 7, the X-axis pulse converting circuit 13 is composed of AND gates Gix ($i=0, \ldots, n-1$), which are adapted to be opened or closed by each of the bits Oix ($i=0, \ldots, n-1$) of the X-axis numerical data (X) outputted from the memory circuit 9 to thereby control the passing of the output of the amplifier Ai, OR gates Gx adapted to have the outputs of these AND gates Gxi as inputs, an inverter Gin and two AND gates Gfx, Grx. A X-axis rotating direction signal Qx, which specifies the rotating direction of a X-axis stepping motor Mx and is outputted from the memory circuit 9, opens the AND gate Gfx in order to lead the output of the OR gate Gx, to the normal rotation terminal 41 of the X-axis driving circuit 15 to thereby normally rotate the X-axis stepping motor Mx. The output Qx of the inverter Gin which reverses the X-axis rotating direction signal Qx of the inverter Gin which closes the AND gate Grx so as to lead the output of the OR gate Gx to the reversing terminal 42 of the X-axis driving circuit 15 to thereby reversely rotate the X-axis stepping motor Mx.

Similarly, the Y-axis pulse converting circuit 14 has the completely same circuit construction as that of the above-described X-axis pulse converting circuit 13. The Y-axis pulse converting circuit is composed of AND gates Giy ($i=0, \ldots, n-1$), which are adapted to be opened or closed by each of bits Qiy ($i=0, \ldots, n-1$), of the Y-axis numerical data (Y) outputted from the memory circuit 9 to thereby control the passing of the output of the amplifier Ai, OR gates Gy adapted to have the outputs of these AND gates Giy as inputs, an inverter Gin and AND gates Gfy and Gry for controlling the output of the OR gate Gy to the normal rotation terminal 43 and the reversing terminal 44 of the Y-axis driving circuit 16 through a Y-axis rotating direction signal Qy and the reversing signal Qy thereof.

The X-axis driving circuit 15 and the Y-axis driving circuit 16, not shown concretely, are respectively composed of conventional ones each including an up-down counter and a power amplifier, etc. which excites, in accordance with the output signal of the up-down counter, each phase of the stators of the X-axis stepping motor Mx and the Y-axis stepping motor My.

The X-axis stepping motor Mx has the output shaft of the stepping motor Max connected with the output shaft of the stepping motor Mbx through the coupling 23*x*, while the Y-axis stepping motor My has the output shaft of the stepping motor May connected with the output shaft of the stepping motor Mby through the coupling 23*y*, as shown in FIG. 2(*a*). However, it is to be noted that according to the present invention, the stepping motor Max is coupled to the stepping motor Mbx and the stepping motor May is coupled to the stepping motor Mby with either the stator or the rotor being aligned in phase and either the other rotor or the stator being displaced by a given angle in a known manner. Excitation is performed by the X-axis driving circuit 15 and the Y-axis driving circuit 16 so that the phases to be excited with respect to the one-stage rotation of the outputs of the X-axis stepping motor Mx and the Y-axis stepping motor My change by one phase in number as a whole, whereby the pulse recurrence frequency increases to improve the speed response property for the movement of the outer frame 22 and the accuracy in the positional control through division of the step angle, and the dual effect of the outputs of the stepping motors Max, Mbx and of the stepping motors May, Mby is adapted to apply a large force upon the outer frame 22 to move the outer frame 22.

The operation of the circuit diagram of FIG. 7 and FIG. 3 will be described hereinafter.

The inner frames F1, F2, F3 and F4 with cloth or the like to be embroidered being stretched thereon are mounted on the outer frame 22, and the numerical data tape 7 is set in the tape reading apparatus 8. Thereafter, upon the turning-on of a power-supply switch (not shown), the tape reading apparatus 8 reads out from the numerical tape 7 the X-axis numerical data (X), the Y-axis numerical data (Y) and the controlling data (R) for the memory circuit 9 after the front tips of the embroidering needles N1, N2, N3 and N4 have left the cloth or the like. The memory circuit 9 then resets the last memory contents and then stores the X-axis numerical data (X), the Y-axis numerical data (X) and the controlling data (R) supplied at this time until the next data is inputted. The X-axis numerical data (X), Y-axis numerical data (Y) and controlling data (R) are outputted, respectively, to the X-axis pulse converting circuit 13, Y-axis pulse converting circuit 14 and sewing machine controlling circuit 10.

The sewing machine driving motor 11 rotates the driving shaft 21 in accordance with the controlling data (R) to drive the sewing heads H1, H2, H3 and H4, so as to thereby rotate the interceptor Pi.

When the X-axis numerical data (X) and Y-axis numerical data (Y) outputted from the memory circuit 9 at this time are, for example, ["Qx|Q6x|Q5x|Q4x|Q3x-|Q2x|Q1x|Q0x"="10000111"] and ["Qy|Q6y|Q-5y|Q4y|Q3y|Q2y|Q1y"Q0y"="00001010"] (in the case of n=7), the AND gates Gfx, G2x, G1x, G0x of the X-axis pulse converting circuit 13 and the AND gates Gry, G3y, Gly of the Y-axis pulse converting circuit 14 open respectively.

Figure 8:
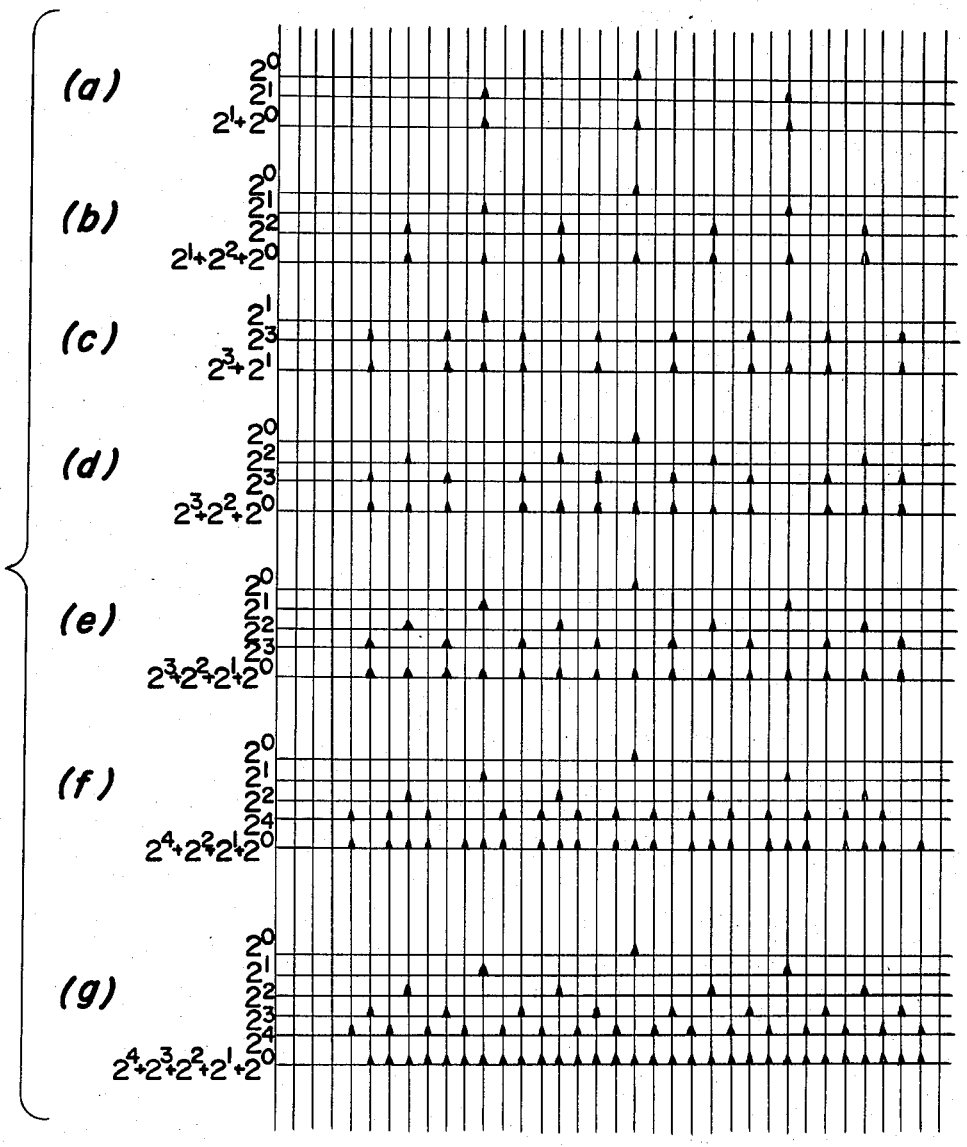
FIGS. 8(*a*) to 8(*g*) are timing charts each illustrating pulses outputted from a pulse generator in response to the X-axis numerical data and the Y-axis numerical data, and pulses inputted to a X-axis stepping motor and a Y-axis stepping motor in the driving apparatus of the present invention.

Accordingly, as shown in FIG. 8(*b*), pulses of $2^2=4$, $2^1=2$, $2^0=1$, the sum of which are seven pulses, are respectively outputted to the OR gate Gx, corresponding to the number of slits Sij provided in the interceptors P2, P1, P0, from the AND gates G2x, G1x, G0x with respect to the rotation of the angle $\theta$ of the interceptor Pi. The seven pulses of "$2^2+2^1+2^0=7$" in the pulse train from the OR gate Gx are outputted to the normal rotation terminal 41 of the X-axis driving circuit 15 from the AND gate Gfx. Also, as shown in FIG. 8(*c*), pulses of $2^3=8$, $2^1=2$ are respectively outputted to the OR gates Gy from the AND gates G3y, G1y, and the ten pulses of "$2^3+2^1=10$" in the pulse train from the OR gate Gy are outputted to the reversing rotation terminal 44 of the Y-axis driving circuit 16 from the AND gate Gry.

Thus, the X-axis stepping motor Mx and the Y-axis stepping motor My perform the normal rotation and reversing rotation, respectively, by seven steps and ten steps, and the outer frame 22 moves by seven units in the positive direction of the X-axis and by ten units in the negative direction of the Y-axis. As apparent from the above description, the pulse train inputted to the X-axis driving circuit 15 and the Y-axis driving circuit 16 is synchronized with the rotation of the interceptor plate Pi, i.e., the rotation of the driving shaft 21, resulting in the fact that the outer frame 22 can normally move to follow the operation speed of the sewing heads H1, H2, H3 and H4.

In FIGS. 8(*a*), 8(*b*), 8(*e*), 8(*f*) and 8(*g*), the X-axis numerical data (X) and the Y-axis numerical data (Y) show the input pulses and output pulses of the OR gates Gx, Gy about the case of "Qx(Qy)0000011", "Qx(Qy)0001101", "Qx(Qy)0001111", "Qx(Qy)0010111" and Qx(Qy)0011111".

Figure 9:
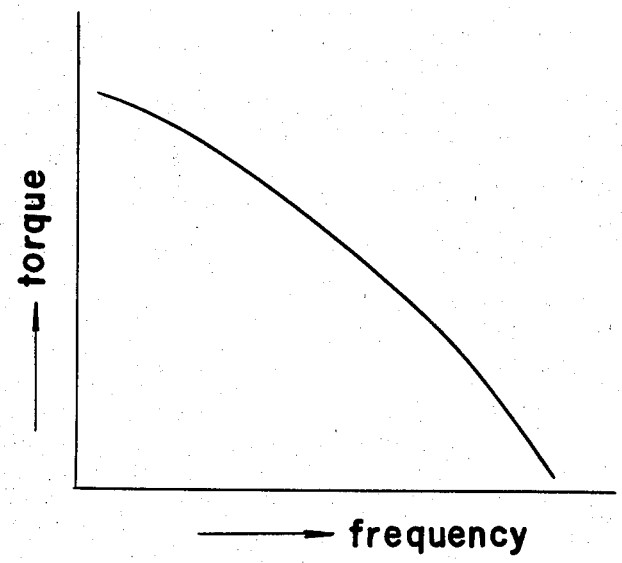
FIG. 9 is a graph illustrating the general relationship between the frequency of pulses inputted to a stepping motor and the output torque thereof, said motor being employed in the driving apparatus of the present invention.
Figure 10:
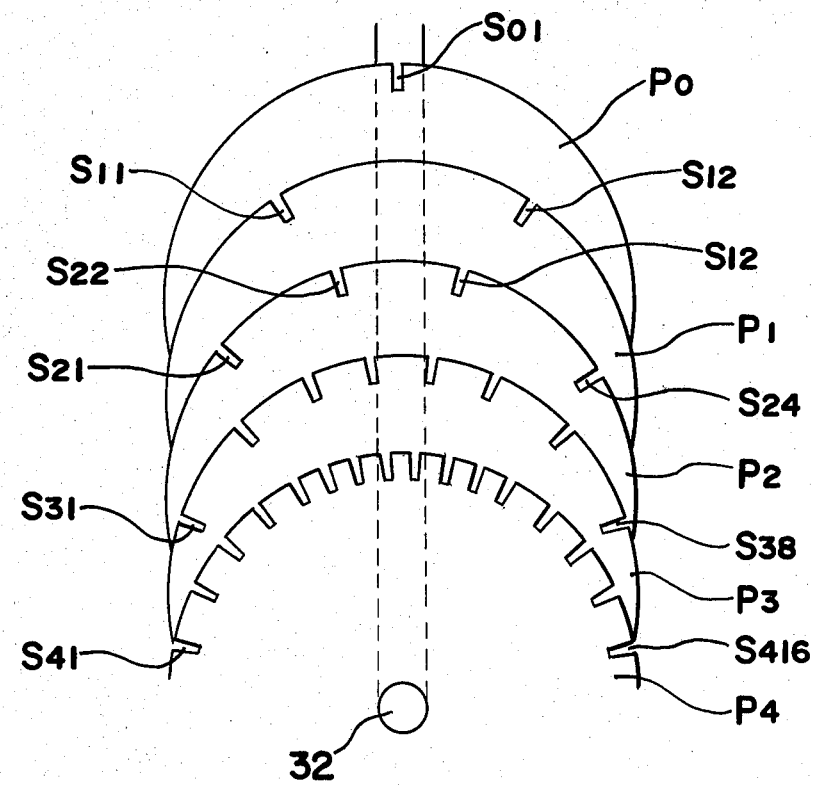
FIG. 10 is a developmental view of an interceptor when the slow up and down motion of the embroidering frame is performed in the driving apparatus of the present invention.
Figure 11:
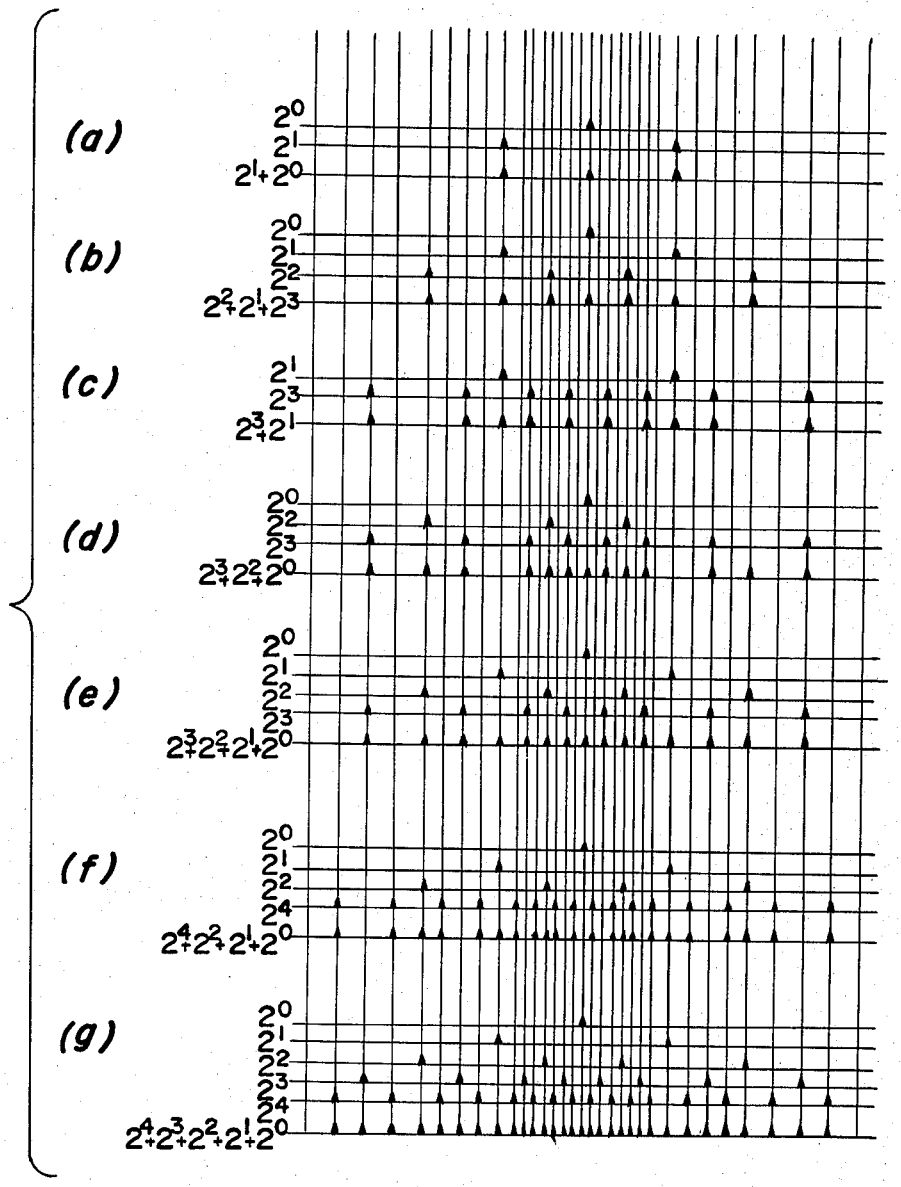
FIGS. 11(*a*) to 11(*g*) are timing charts each illustrating pulses outputted from a pulse generator and pulses inputted to a X-axis stepping motor and a Y-axis stepping motor during the slow up and down motion in the driving apparatus of the present invention.

As shown in FIG. 9, the output torque of the stepping motor M generally becomes smaller as the frequency of the input pulses increase, since there is a relationship between the frequency of the pulses applied to the stepping motor and the output torque thereof. Accordingly, in place of the evenly distributed slits Si; formed on the periphery of the interceptor Pi as shown in FIG. 5, the intervals between neighboring slits are made sequentially closer, and are made closest at locations where the embroidering needles N1, N2, N3 and N4 are farthest from the cloth, and are made wider in both ends of the distribution as the embroidering needles N1, N2, N3 and N4 get closer to the cloth, as shown in FIG. 10. Thus, the pulses of low frequency are inputted with an uneven distribution of slits as shown in FIGS. 11(*a*) to 11(*g*), corresponding to FIGS. 8(*a*) to 8(*g*) showing an even distribution of slits; the pulses are input to the X-axis stepping motor Mx and the Y-axis stepping motor My at the drive time or at the stop time of the outer frame 22, and the X-axis stepping motor Mx and Y-axis stepping motor My can therefore provide large output torques to the outer frame 22. After the outer frame 22 has been driven, the pulses of relatively high frequency are inputted to the X-axis stepping motor Mx and Y-axis stepping motor My, thus allowing the outer frame 22 to be quickly moved while allowing the so-called slow up and down movement of the outer frame 22 to be performed.

Figure 12:
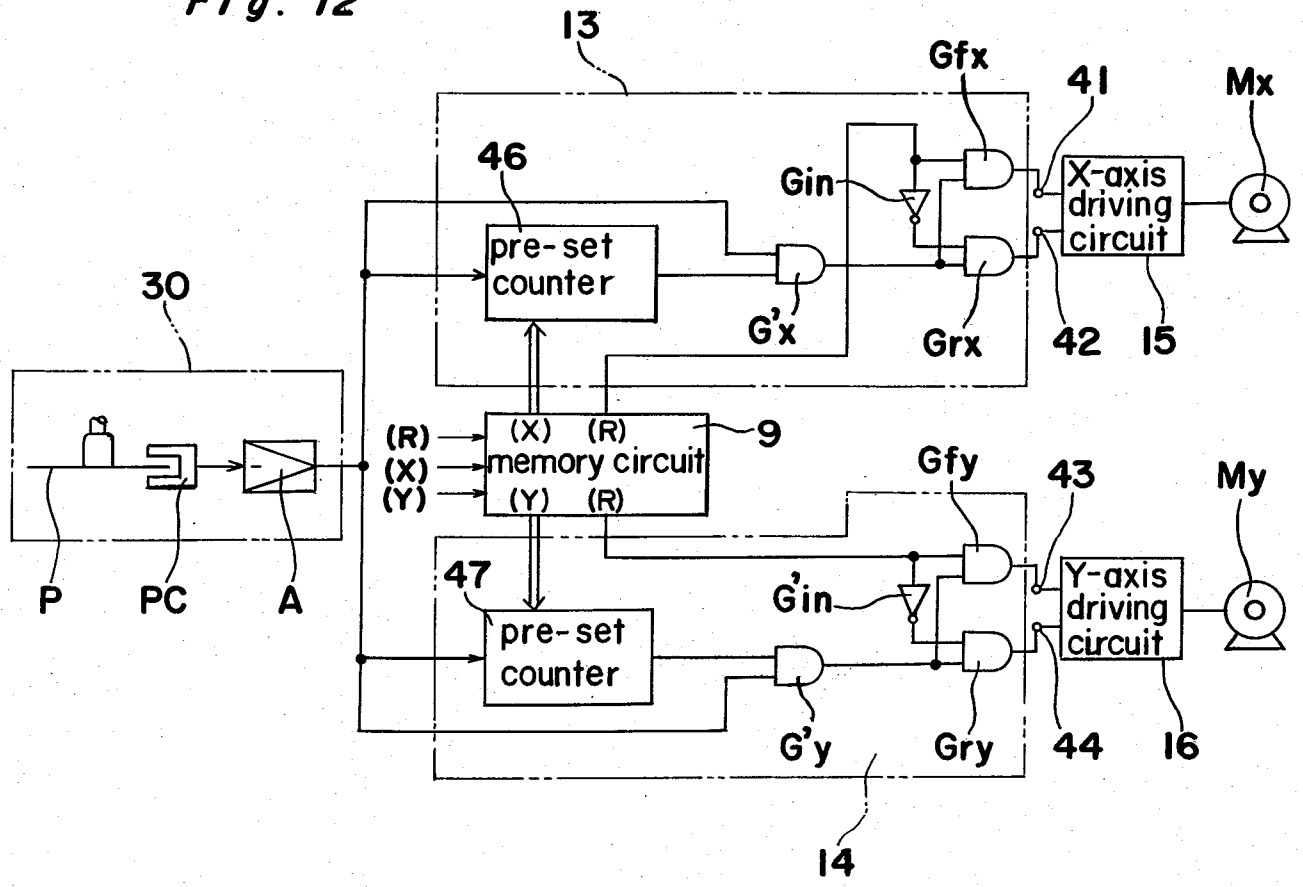
FIG. 12 is a block diagram of a driving apparatus in a second embodiment of the present embodiment.
Figure 13:
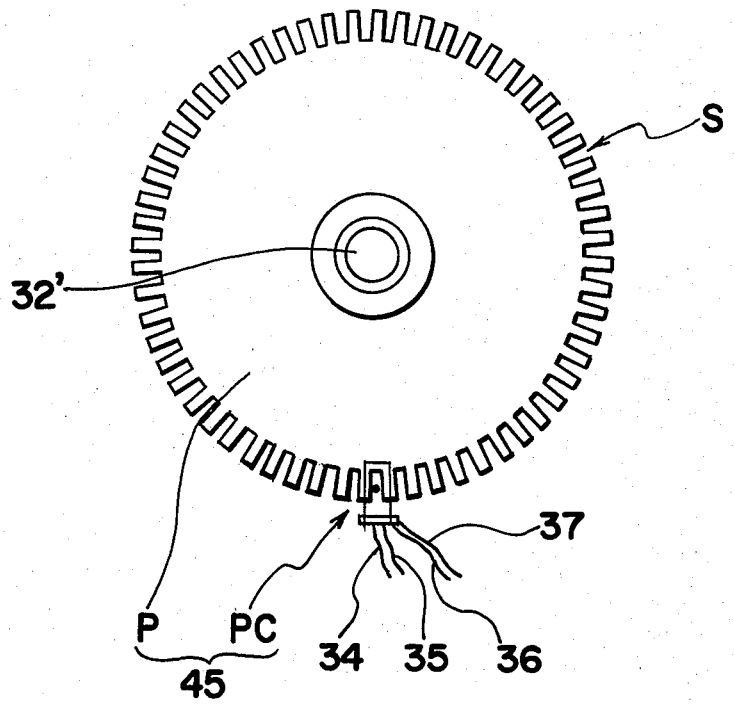
FIG. 13 is a circuit diagram of a pulse generator to be employed in the driving apparatus of FIG. 12.

FIG. 12 shows a second embodiment of the present invention, wherein an encoder 45 is used as a pulse generator 30 as shown in FIG. 13. The encoder 45 is composed of an interceptor P and a photo-coupler PC, the interceptor P having on its periphery at least $2^n$ the slits S for the said angle $\theta$ with respect to the bit number n of the X-axis numerical data (X) and the Y-axis numerical data (Y) and being adapted to rotate together with the driving shaft 21 with the shaft 32' of the interceptor being combined with the driving shaft 21 and the photo-coupler being completely the same in construction as the photo-coupler PGi shown in FIG. 4.

The X-axis pulse converting circuit 13 also counts pulses outputted from an inversion amplifier A, which inverts and amplifies the output of the photo-coupler 45, with the X-axis numerical data (X) outputted from the memory circuit 9, instead of the AND gate Gix and the OR gate Gx as shown in FIG. 7, being provided as a pre-set value. A pre-set counter 46 and the AND gate G'x are used, the pre-set counter 46 being adapted to keep the AND gate G'x open until the count value increases from 1 to the pre-set value, and the AND gate G'x being controlled through the output of the pre-set counter 46 and adapted to control the passing of the pulses to be outputted from the inversion amplifier.

On the other hand, the Y-axis pulse converting circuit 14, also, counts pulses to be outputted from the amplifier, in the same manner as described hereinabove, with the Y-axis numerical data (Y) as a pre-set value, and is adapted to employ a pre-set counter 47 for controlling the AND gate G'y and the AND gate G'y controlled by the pre-set counter 47.

When the driving apparatus of the outer frame 22 is constructed as described hereinabove, the pre-set counter 46 keeps the AND gate G'x open until the count value increases from 1 to 7 pulses of "$2^2+2^1+2^0=7$" if the X-axis numerical data (X) and the Y-axis numerical data (Y) are, for example ["Qx|Q6x|Q5x|Q4x|Q3x|Q2x|Q1x-|Q0x"="10000111"] and ["Qy|Q6y|Q5y|Q4y|Q-3y|Q2y|Q1y|Q0y"="00001010"] (in case of n=7). And, the AND gate G'x sends seven pulses, among pulses outputted from the inversion amplifier A, to the AND gates Gfx and Grx. Since the condition of [Qx="1"] is established at this time, the AND gate Gfx opens, the seven pulses are fed to the normal rotation terminal 41 of the X-axis driving circuit 15. On the contrary, the pre-set counter 47 keeps the AND gate G'y open until the count value increases from 1 to 10 pulses of "$2^3+2^1=10$", and the AND gate G'y sends ten pulses, among pulses outputted from the inversion amplifier A, to the AND gates Gfy and Gry. Since the condition of [Qy="0"] is established at this time, the AND gate Gry opens, and the ten pulses are fed to the reversing terminal 44 of the Y-axis driving circuit 16.

Accordingly, as in FIG. 7, the outer frame 22 moves in synchronization with pulse train from the encoder 45, i.e., is synchronized with the vertical motion speeds of the embroidering needles N1, N2, N3 and N4 to move at each step by seven bits in the positive direction of the X-axis and by ten bits in the negative direction of the Y-axis.

Everytime the new X-axis numerical data (X) and the Y-axis numerical data (Y) are sent from the memory circuit 9, the outer frame 22 moves, synchronizing with the vertical speeds of the embroidering needles N1, N2, N3 and N4, to perform the embroidering operation in the automatic sewing machine.

In the case of the present embodiment, as apparent from FIG. 8, pulses are inputted, to the X-axis stepping motor Mx and the Y-axis stepping motor My, at an even distribution with respect to the rotation of the angle $\theta$ of the interceptor Pi in the embodiment of FIG. 7. The outer frame 22 completes its motion during a period while the front tip of the embroidering needles N1, N2, N3 and N4 leave the cloth or the like and are thrust into the cloth or the like again. In the present embodiment, the pulse train, composed of pulses corresponding in number to the X-axis numerical data (X) and the Y-axis numerical data (Y), is inputted from the pulse train to be continuously outputted from the encoder 45 to the X-axis stepping motor Mx and the Y-axis stepping motor My. Thus, when the X-axis numerical data (X) and the Y-axis numerical data (Y) are small in value in comparison with the maximum value thereof, the motion of the outer frame 22 is adapted to be completed in a short period after the front tips of the embroidering needles N1, N2, N3 and N4 have left the cloth or the like.

The present invention is not restricted to the above-described embodiments. The well-known means such as photo-pulse generator, gear switch system, high-frequency induction system, magnetic slit system, magnetic field switching system or the like can be used as a pulse generator 30. A pulse generator which performs completely the same logical operation as the pulse generator 30 of FIG. 7 performs can be provided through combination of a binary counter for counting the output pulses of a pulse generator 30 of the same construction as shown in FIG. 12, a 16-line decoder for converting the binary output of the binary counter into hexagonal bits, a diode matrix, etc. Also, the number of sewing machine heads is not restricted to four as in the above-described embodiments and the present invention can be applied to the sewing machine heads of one through three or five or more. In addition, the X-axis stepping motor Mx or the like can be composed of one stepping motor or three stepping motors or more.

As apparent from the above-detailed description, pulses are outputted, synchronizing with the rotation of the drive shaft for moving the sewing needles, from a pulse generator which moves the retaining frames of an object-to-be-sewed in the X-axis direction and the Y-axis direction at a timing determined by the output pulse to thereby move the retaining frames of the object-to-be-sewed in a synchronous relationship with respect to the motion of the sewing heads. The motion of the retaining frame can be completed before the front tips of the sewing needles are thrust into the object-to-be-sewed. Accordingly, the embroidering needles are not broken even if the cloth-to-be-sewed changes in thickness. Various sewing operations can be smoothly performed in accordance with the motion of the synchronized embroidering needles.

Although the present invention has been described and illustrated in detail, it is to be clearly understood that the same is by way of limitation, the spirit and scope of the present invention being limited only by the terms of the appended claims.

What is claimed is:

1. A driving control apparatus in an automatic sewing machine for a pattern controlled displacement of a sewing object frame in both X- and Y-directions by means of respective X and Y stepping motors comprising:

a pulse generator synchronized with a needle drive shaft of said sewing machine, which for each needle cycle produces a clock pulse train having a predetermined number of pulses, said pulse train being produced over a predetermined angular interval of said needle shaft when a needle of said sewing machine is not engaging an object to be sewed;

read-out means for reading controlling data corresponding to the value of the X and Y-displacements for said each needle cycle from a stored pattern program;

and a pair of pulse control circuit means for transmitting a portion of each clock pulse train from said pulse generator for use as a control pulse train for said X and Y stepping motors, respectively, said transmitted portion being proportional to said read-out control data from said read-out means;

wherein each of said pulse control circuit means produces said control pulse train with substantially the same duration as that of said clock pulse train by suppressing clock pulses distributed over the length of said clock pulse train.

2. A driving control apparatus as claimed in claim 1, wherein said pulse generator produces each of said clock pulse trains with unequal pulse intervals between the pulses thereof, said intervals being first decreasing and then increasing during said predetermined angular interval of said needle shaft.

3. A driving control apparatus as claimed in claims 1 or 2, wherein said pulse generator produces each of said clock pulse trains as a superposition of separately supplied individual pulse trains, the number of pulses of pulse intervals of said individual pulse trains being related to each other as powers of 2, and wherein each of said pulse control circuit means comprises selectively controllable gates for each of said individual pulse trains.

4. A driving control apparatus as claimed in claims 1 or 2, wherein said pulse generator produces said clock pulse train during the angular interval between angular positions of 180° and 200° of said needle drive shaft.

5. A driving control apparatus as claimed in claim 3, wherein said pulse generator produces said clock pulse train during the angular interval between angular positions of 180° and 200° of said needle drive shaft.

6. A driving control apparatus as claimed in claim 1, wherein said read-out means additionally reads out needle drive control data for the drive of said needle drive shaft from said pattern program and wherein said needle drive control data is supplied to a shaft drive means via a drive control circuit means which is uninfluenced by clock pulses from said pulse generator.

* * * * *